United States Patent [19]

Dwiggins

[11] Patent Number: 4,657,633

[45] Date of Patent: Apr. 14, 1987

[54] DELIGNIFICATION AND BLEACHING OF A CELLULOSE PULP WITH AN ALKALIOXYGEN-HYPOCHLORITE SINGLE STAGE SEQUENTIAL EXTRACTION

[75] Inventor: David F. Dwiggins, Goose Creek, S.C.

[73] Assignee: Westvaco Corporation, New York, N.Y.

[21] Appl. No.: 737,463

[22] Filed: May 24, 1985

[51] Int. Cl.[4] ..... D21C 9/12; D21C 9/14; D21C 9/147

[52] U.S. Cl. ..... 162/65; 162/89

[58] Field of Search ..... 162/88, 89, 65, 90, 162/19

[56] References Cited

U.S. PATENT DOCUMENTS

| | | | |
|---|---|---|---|
| 4,008,120 | 2/1977 | Carles et al. | 162/89 |
| 4,081,317 | 3/1978 | Gall et al. | 162/88 |
| 4,586,420 | 2/1986 | Nonni | 162/65 |

FOREIGN PATENT DOCUMENTS

| | | | |
|---|---|---|---|
| 0049305 | 4/1977 | Japan | 162/88 |

OTHER PUBLICATIONS

Chan et al "Modified Bleaching Sequences" *Pulp & Paper Canada,* 86: 1(1985) paper presented 1-31 83-2--4-83.

*Primary Examiner*—Steve Alvo

*Attorney, Agent, or Firm*—Terry B. McDaniel; Richard L. Schmalz

[57] ABSTRACT

An improved process for bleaching and delignifying cellulose pulp. The process comprises subjecting the pulp to a bleaching stage followed by washing, and thereafter extracting the bleached pulp as received from the bleaching stage in a caustic extraction stage in the presence of oxygen and hypochlorite. The preferred embodiment is a sequential treatment of the bleached pulp with oxygen and hypochlorite without a pulp washing step between chemical additions. The process is characterized by enhanced delignification with high brightness and high viscosity. The process is further characterized by extraction stage filtrates of improved environmental characteristics.

14 Claims, No Drawings

DELIGNIFICATION AND BLEACHING OF A CELLULOSE PULP WITH AN ALKALIOXYGEN-HYPOCHLORITE SINGLE STAGE SEQUENTIAL EXTRACTION

BACKGROUND OF THE INVENTION

This invention relates to an improved process for bleaching cellulose pulp. In the production of bleached pulp, brown stock is subjected to a series of sequential bleaching and extraction treatments. A variety of bleaching sequences are employed in the industry. Bleaching may be accomplished using chlorine, chlorine dioxide, or mixtures thereof, under acid conditions, or, alternatively, by using oxygen, ozone, peroxide, or hypochlorite under alkaline conditions. Among the most common of these are the chlorine-based processes including the well known CEDED bleaching process and its variants, including the CEHDED bleaching sequence. In the first stage of these processes (bleaching), the pulp is treated typically with chlorine as a gas, as an aqueous gas bubble suspension, or as a dissolved chlorine solution (chlorination) under acid conditions and is washed. In the second stage, the pulp is extracted, typically with sodium hydroxide, in order to remove a significant portion of the lignin. Extraction of the alkali soluble lignin serves to reduce chemical costs in subsequent stages and improves the finished pulp properties overall. An effective caustic extraction stage, therefore, is very desirable in achieving an acceptable finished product in a cost-effective manner.

Various methods have been suggested for achieving enhanced delignification at an early stage in chlorine-based bleaching processes. For example, U.S. Pat. No. 4,451,332 describes a variant of the caustic extraction stage wherein an oxygen-containing gas is mixed with a chlorinated pulp to form a foam which is extracted. U.S. Pat. No. 4,081,317 describes a process for reducing effluent color which involves extracting the pulp with hypochlorite as an adjunct to, or in place of, the caustic extraction stage.

U.S. Pat. No. 2,147,618 describes a process wherein a pulp is treated with chlorine under acid conditions to produce a chlorinated pulp, and the chlorinated pulp is then rendered alkaline and treated with oxygen to remove coloring material. The patent does not describe the extraction of lignin and impurities in a caustic extraction stage, however. The pulp is washed following the oxygen treatment and is then bleached, preferably with hypochlorite, during which air or oxygen is optionally bubbled through the suspension.

It is an object of the present invention to provide a bleaching process which provides a sequentially bleached and extracted pulp with improved pulp properties. These properties include enhanced extraction stage delignification and final bleached brightness without a significant loss in pulp viscosity, which translates into a reduction in the strength properties of the finished paper product.

While many years ago bleach effluents were not considered to be an environmental threat, improvements in pulping and chemical recovery and an increased awareness of the effects of effluent color and toxicity have led to the realization that bleach plant effluents are now one of the most serious environmental problems in the pulp and paper industry. The primary sources of bleach plant pollutants are the chlorination and extraction stages. Lignin and lignin degradation products contribute color, COD, BOD, and toxicity. Hemicelluloses contribute BOD. Bleaching chemicals contribute to effluent toxicity through residual free chlorine and the formation of chlorinated organics. Resins, terpenes, and extractives contribute odor, taste, and toxicity. The alkali extraction stage is the major generation point of bleach plant effluent loadings due to the dissolution of chlorinated lignins. Because more residual lignin must be removed from softwood pulps, softwood bleaching produces more pollution than hardwood bleaching.

Reduction of the environmental impact of bleaching effluents can be achieved in two ways. Waste streams can be treated outside of the bleach plant before discharge or the quantity and quality of the waste streams can be altered by in-plant process changes. Bleach plant wastes are commonly treated with the total mill effluent, and treatment costs are directly related to total effluent volume. Specific treatment of the limited extraction stage flow rather than the total plant volume is one approach to cost reduction. In-plant process changes can be more economical and may result in improved pulp bleaching. In particular, bleaching sequence modifications which improve the quality of bleach plant effluents are desirable.

Therefore, it is a further object of the present invention to provide a bleaching process modification, i.e., chemically reinforced extraction, which has positive effects on the environmental characteristics of the resulting extraction stage filtrates. Also, it is an object of the present invention to provide a chemically reinforced extraction stage which is inexpensive and easy to implement.

SUMMARY OF THE INVENTION

It has been found that the addition of oxygen and hypochlorite in the post-bleaching caustic extraction stage provides an extracted pulp with improved properties including relatively high viscosity, low 25 ml. permanganate numbers, improved brightness and which provides extraction stage effluents exhibiting improved environmental characteristics. The use of the present invention will potentially reduce chemical costs in subsequent stages, and particularly expenditures associated with chlorine dioxide consumption. An increased ceiling brightness for a given pulp is also possible. In a particular preferred embodiment, the oxygen and hypochlorite are added sequentially in corresponding order without an intrastage wash step. The omission of this wash step, contrary to conventional wisdom in the art, facilitates the addition of the hypochlorite at relatively high concentrations without the expected commensurate losses in pulp viscosity and, consequently, losses in strength. Moreover, the enhanced degree of delignification which is achieved with all embodiments of the invention without significant commensurate losses in viscosity is highly desirable. The novel process disclosed and claimed herein comprises subjecting the pulp to a bleaching stage where the pulp is bleached, and is thereafter washed, whereupon the bleached pulp as received from the bleaching stage is subjected to a caustic extraction stage wherein the pulp is contacted with oxygen and hypochlorite.

The bleaching stage, or stages, preceding the extraction stage may be accomplished by various means. Bleaching can be achieved with chlorine, chlorine dioxide, or mixtures thereof, under acid conditions. Alternatively, bleaching may be achieved with oxygen, ozone, peroxide, or hypochlorite under alkaline conditions. Also, additional bleaching may occur subsequent to the described extraction stage.

DESCRIPTION OF THE PREFERRED EMBODIMENTS

In selecting and implementing a particular bleaching process a commercial user must be concerned with a multiplicity of factors including the extent of delignification, the brightness of the pulp, the strength of the finished product, and the cost of the bleaching treatments. These factors are interrelated so that, for example, extensive delignification at an early stage of the process and subsequent extraction of the lignin reduces chemical demand in subsequent stages and consequently reduces the overall costs associated with the process. In order to achieve extensive delignification, however, degradation of the pulp with corresponding losses in the strength properties of the finished paper product may be experienced. This creates a distinct, acute problem for the manufacturer. Therefore, the selection of a particular bleaching sequence involves a careful balancing of relevant factors.

The addition of oxygen and hypochlorite in the post-bleaching extraction stage facilitates extensive pulp delignification in the early stages of the bleaching sequence. This may be accomplished in a variety of ways. It should be understood that the use of the term "oxygen" herein encompasses a variety of gases which contain oxygen, including air. In a similar fashion, the term "hypochlorite" encompasses a variety of hypochlorite salts, including calcium hypochlorite and sodium hypochlorite.

The principal variants of the novel process may be characterized by the order in which the oxygen and hypochlorite are added to the pulp. A particular preferred embodiment involves the sequential addition of oxygen and hypochlorite. However, the addition may be made in reverse order, or even simultaneously. The best results, though, have been achieved with the sequential oxygen/hypochlorite embodiment as will be demonstrated below in connection with illustrative examples.

In the process according to the present invention, caustic is generally added to the pulp in an amount sufficient to extract the pulp after a bleaching stage and to serve as a buffer for the hypochlorite. The caustic is added at a level which will preferably provide a final pulp pH of at least about 10.5. Thereafter, the pulp is mixed with oxygen and hypochlorite, and the pulp is subjected to ordinary caustic extraction conditions. In the sequential oxygen/hypochlorite embodiment, the caustic required to serve as a buffer for the hypochlorite can be mixed with the pulp prior to treatment with the oxygen. Or, the buffer may be added following the oxygen enhanced extraction treatment and prior to or concurrently with the addition of the hypochlorite for the second step in the caustic extraction stage.

The process is effective in bleaching pulps derived from softwoods, hardwoods, or mixtures of the two. Where the process is used with softwood-derived pulps, caustic for the extraction stage preferably should be added at a level to keep the final pH of the pulp at 10.5 and above. Hypochlorite is preferably added at a concentration level in the range from about 1% to about 2% as chlorine on pulp (the term "on pulp" refers to oven-dried weight basis). Buffer caustic is preferably provided in an amount equal to 0.4 times the percentage of the hypochlorite addition level as chlorine on pulp (i.e., in the range from about 0.4% to about 0.8% on pulp). As noted, the buffer caustic is mixed with the pulp either before or after the oxygen enhanced extraction step in the sequential oxygen/hypochlorite embodiment. In the sequential hypochlorite/oxygen and simultaneous embodiments, all of the caustic should be mixed with the pulp prior to treatment with the prescribed agents. The consistency of the pulp should be maintained in the range from about 8% to 15% on an oven-dried weight basis, and preferably about 12%.

Where the process is utilized with pulps derived from hardwoods, caustic for the extraction stage preferably should be added at a level sufficient to maintain the final pulp pH at 10.5 and above as in the case of softwoods. Hypochlorite preferably is applied at a level in the range from about 0.5% to 1.0% as chlorine on pulp. As in the case of pulps derived from softwoods, the level of buffer caustic addition is 0.4 times the corresponding percentage level of hypochlorite addition. The manner of caustic addition and the pulp consistency are the same as in the case of softwood pulps.

In the case of mixtures of hardwood and softwood-derived pulps, the concentration level of caustic addition will be the same as noted above for hardwoods and softwoods (sufficient to maintain a final pulp pH of 10.5 or greater). The levels of buffer caustic and hypochlorite addition may be calculated on a proportionate basis based upon the composition of the mixture according to the above-noted standards for softwoods and hardwoods, respectively. As a result, the concentration level of buffer caustic addition will fall in the preferred range from about 0.2% to 0.8% and the level of hypochlorite addition will preferably fall within the range from about 0.5% to 2% as chlorine on pulp.

In all of the embodiments, oxygen should be provided in an amount sufficient to create an oxygen-rich atmosphere when mixed with the pulp. The oxygen should be added to the pulp in a manner which creates and maintains superatmospheric conditions for a preferred minimum retention period of at least about three minutes. By way of example, when using pure oxygen in the laboratory, a gauge pressure fifteen (15) pounds per square inch following a purge of any air in the treatment vessel provides highly satisfactory results.

In the embodiments wherein oxygen and hypochlorite are added sequentially (in either order), the pulp is not washed until the extraction, with both components, is complete. Tests have shown that in an oxygen/hypochlorite sequential extraction employing a post-oxygen intermediate extraction wash step significant viscosity losses result when the pulp is subsequently bleached with similar levels of hypochlorite. While this phenomemon is not fully understood, the presence of compounds in the filtrate generated in the oxygen phase of the treatment are suspected to minimize the degrading effects of the subsequent treatment with hypochlorite. Regardless of the theoretical explanation for the phenomenon, the net result is that the pulp may be treated with relatively higher concentrations of hypochlorite in the extraction stage without compromising pulp viscosity. Moreover, the degree of delignification, as represented by lower CE kappa numbers, is enhanced which should also reduce chemical consumption in the remaining bleaching stages. Rather than reduce chemical demand, the commercial user may instead opt for a bleached product with a higher ceiling brightness than is achievable with conventional bleaching schemes that do not utilize the present invention. An added benefit of the process is that significant improvements in extraction stage filtrate color have been observed, as set forth below in the examples. These improvements are very significant in light of the desire of the industry to continually improve its impact on the environment.

In practice, the process is easily implemented with only minor modifications to existing equipment in the bleach plant. For example, the oxygen enhanced extraction in the sequential oxygen/hypochlorite caustic extraction stage may be accomplished in a conventional upflow tube, while a mixer may be employed in the cross-over tube to the main tower to mix the hypochlorite and any buffer caustic with the pulp. The oxygen phase of the extraction should require approximately 3 to 10 minutes. A three-minute retention time at an oxygen partial pressure of approximately 20 p.s.i.g. is preferred, although longer retention times are acceptable. The hypochlorite phase of the extraction should typically require a 30 to 60-minute retention time to allow completion of the extraction stage. Overall retention times may be slightly longer than that experienced with a conventional extraction stage. Also in practice, the bleached pulp temperature may be raised, usually by steam mixing, up to a range from about 100° F. to 180° F. in order to increase the driving force for the chemical reactions involved in the extraction. This heating step may occur before the caustic is added, or alternatively before the addition of either the oxygen or the hypochlorite (regardless of the sequence which is followed).

Following the extraction stage the pulp may be treated in subsequent bleaching treatments, such as with hypochlorite or chlorine dioxide for example, to produce a finished bleached pulp product. Additional parameters of the process as well as the advantages of the present invention will be demonstrated below in connection with the illustrative examples.

EXAMPLE I

In a first series of experiments the advantages of the present invention over known methods were demonstrated in connection with softwood pulp.

The pulp was subjected to a chlorine bleaching stage in a conventional manner using chlorine gas and washed. Samples of the chlorinated pulp were then subjected to various caustic extraction treatments including:

| Sequence | Treatment |
|---|---|
| E | Conventional Extraction |
| $E_O$ | Oxygen Reinforced Extraction |
| $E_H$ | Hypochlorite Reinforced Extraction |
| $E_{OH}$ | Oxygen and Hypochlorite Reinforced Extraction (simultaneous addition) |
| $(E_{O\rightarrow H})$ | Oxygen and Hypochlorite Reinforced Extraction (sequential addition) |
| $(E_{H\rightarrow O})$ | Hypochlorite and Oxygen Reinforced Extraction (sequential addition) |

The extractions were carried out in a tumbling autoclave at a pulp consistency of 11.72% on an oven-dried weight basis. A pulp charge of 26 grams, oven-dried weight basis, was used for each extraction sequence. Caustic for the extractions was uniformly kneaded into the pulp at a concentration level of 4% on pulp prior to any additional treatments. The autoclave was tested for leaks prior to transferring the vessel into a roller oven for the extractions. The following variants of this procedure were used:

Conventional Extraction (E)

The chlorinated pulp which had been mixed with caustic was then placed in the autoclave and transferred to a roller oven for three hours at 165° F. Long reaction times were necessary due to the large mass of the laboratory autoclave and the relatively inefficient heating of that autoclave in a forced convection roller oven. In commercial practice much shorter reaction times will be required.

Oxygen Reinforced Extraction ($E_O$)

The procedure outlined above for the conventional extraction was followed except that the autoclave was pressurized with oxygen at 15 p.s.i.g. and vented four times to ensure an oxygen rich atmosphere prior to placing the autoclave in the oven. The final oxygen partial pressure was 15 p.s.i.g. This pressure was not reduced during the course of the reaction.

Hypochlorite Reinforced Extraction ($E_H$)

The same procedure as outlined for the conventional extraction was followed except that additional caustic to serve as a buffer for the hypochlorite was mixed with the pulp (0.4% on pulp in addition to the 4.0%). Thereafter, sodium hypochlorite was added at a 1% addition level as chlorine on pulp, the autoclave was sealed, and the extraction conditions were created by transferring the autoclave to the oven as before.

Simultaneous Oxygen and Hypochlorite Reinforced Extraction ($E_{OH}$)

This extraction was carried out in the same manner as the hypochlorite reinforced extraction ($E_H$) except that following the addition of the sodium hypochlorite, oxygen was introduced into the autoclave and pressurized to 15 p.s.i.g. (four cycles) to ensure an oxygen rich atmosphere. The autoclave was then transferred to the oven for extraction at 165° F. for three hours. The final oxygen partial pressure was 15 p.s.i.g. This pressure was not reduced during the course of the reaction.

Sequential Oxygen/Hypochlorite Reinforced Extraction ($E_{O\rightarrow H}$)

In this extraction sequence the pulp was subjected first to the same procedure as set forth above for the oxygen reinforced extraction ($E_O$) including the extraction at 165° F. for three hours. The autoclave and its contents were then removed from the oven to cool in a water bath. The pulp inside the autoclave was removed and placed in a heavy plastic bag. Additional caustic to serve as a buffer for the hypochlorite and hypochlorite were added and mixed with the pulp at levels of 0.4% on pulp and 1.0% as chlorine on pulp, respectively. The pulp was returned to the autoclave, which in turn was returned to the oven for a second three-hour extraction at 165° F.

Sequential Hypochlorite/Oxygen Reinforced Extraction ($E_{H\rightarrow O}$):

In this extraction, the pulp was subjected to the same treatments as set forth above for the hypochlorite reinforced extraction ($E_H$) using the same concentration levels of caustic (including buffer caustic), and hypochlorite. The autoclave was heated in the oven for three hours at 165° F. Thereafter, the autoclave was cooled and oxygen was admitted to the autoclave up to a gauge pressure of 15 p.s.i.g. (four cycles) to ensure an oxygen rich atmosphere. The autoclave was then returned to the oven for an additional three hours of extraction at 165° F. The final oxygen partial pressure was 15 p.s.i.g. This pressure was not reduced during the course of the reaction.

Following the completion of each of the respective treatments set forth above, the autoclave was cooled in a water bath at room temperature. The pulp sample was washed in a Buchner funnel with approximately 6 liters of deionized water. The pulp was dewatered with a rubber dam whereupon a 25 ml. permanganate number was obtained as well as a viscosity determination and a brightness measurement. The results of these measurements are reported in Table I which follows.

TABLE I

| | (1.0% Hypochlorite as $Cl^-$) | | |
|---|---|---|---|
| Treatment | 25 ml. K No. | Viscosity (cp.) | Brightness (G.E.) |
| E | 3.75 | 23.1 | 35.7 |
| $E_O$ | 2.66 | 21.8 | 43.5 |
| $E_H$ | 3.24 | 23.3 | 38.9 |
| $E_{OH}$ | 2.48 | 21.2 | 47.4 |
| $(E_{O\rightarrow H})$ | 1.98 | 21.3 | 52.3 |
| $(E_{H\rightarrow O})$ | 2.44 | 21.7 | 46.5 |

These results clearly demonstrate the advantages that may be obtained by using the invention described herein. The results shown above for the sequential oxygen/hypochlorite embodiment are particularly positive and surprising. The pulp in this series was subjected to a six-hour extraction (total) due to heating limitations. As set forth in Example III, below, additional experimentation indicates that the extended reaction time does not account for the beneficial results that were achieved. In addition, tests in the laboratory indicate that the achieved results are highly reproducible. In practice, the conditions necessary to simulate a commercial process in the laboratory are not required and only slightly longer retention times in the extraction stage may be necessary with this embodiment.

EXAMPLE II

A second series of experiments was conducted with softwood pulp wherein the hypochlorite addition level was increased to 2.0% as chlorine on pulp. This necessitated an increase in the caustic addition level to 4.8% total on pulp (0.8% serving as a buffer for the hypochlorite). Pulp samples were subjected to the treatments set forth above under Example I except for the hypochlorite/oxygen reinforced extraction ($E_{HO}$) which was not performed. In addition, the extraction stage filtrate was measured to determine the effects of the process on filtrate color. The results are reported below in Table II.

TABLE II

| | (2.0% Hypochlorite as $Cl^-$) | | | |
|---|---|---|---|---|
| Treatment | 25 ml. K No. | Viscosity (cp.) | Brightness (G.E.) | Color (PT-CO Units) |
| E | 3.56 | 22.2 | 35.8 | 35,500 |
| $E_O$ | 2.70 | 20.9 | 43.0 | 23,200 |
| $E_H$ | 2.54 | 21.7 | 45.9 | 20,800 |
| $E_{OH}$ | 2.06 | 20.5 | 54.6 | 15,200 |
| $(E_{O\rightarrow H})$ | 1.05 | 19.2 | 63.6 | 9,000 |

At higher hypochlorite concentrations, the novel extraction stage performed surprisingly well, particularly with regard to the viscosity of the pulp in light of the significant brightness improvement and high level of delignification achieved. Once again, this is especially true of the sequential oxygen/hypochlorite reinforced extraction sequence. Also, the extraction stage filtrate color was much improved. Dramatic color reduction of the filtrate was achieved by the sequential oxygen/hypochlorite reinforced extraction sequence.

EXAMPLE III

In a third series of experiments, it was demonstrated that the beneficial effects achieved with the sequential oxygen/hypochlorite reinforced extraction are not due to the extended extraction sequence which was required in the laboratory. In this series, pulps were treated as set forth in Example II according to the respective procedures for the conventional extraction (E), the oxygen reinforced extraction ($E_O$), and the hypochlorite reinforced extraction ($E_H$). Instead of the conventional three hour exposure time in the oven, these samples were left therein for six hours. The data shown below in Table III may be directly compared to the data shown in Table II, above. Although some improvement in the Kappa numbers apparently resulted from the longer treatment period, the brightness levels fall short of that achievable with the sequential oxygen/hypochlorite reinforced extraction sequence.

TABLE III

| | (2.0% Hypochlorite as $Cl^-$) (Six Hour Extraction) | | |
|---|---|---|---|
| Treatment | 25 ml. K No. | Viscosity (cp.) | Brightness (G.E.) |
| E | 3.26 | 22.4 | 37.1 |
| $E_O$ | 2.18 | 20.9 | 47.6 |
| $E_H$ | 2.28 | 22.0 | 46.2 |

EXAMPLE IV

In this series of experiments, the effectiveness of the process was demonstrated with pulp derived from hardwoods. The same procedures were followed as set forth in Example I except that hypochlorite was added at levels of 1% as chlorine on pulp (with the same level of buffer caustic, where required, as set forth in Example I–0.4% on pulp). Also, caustic for the extraction was added at levels of 2.0% on pulp for the hardwood extractions. Measurements of extraction stage filtrate color were also obtained. The results of the testing are reported below in Table IV.

TABLE IV

| | (1.0% Hypochlorite as $Cl^-$) | | | |
|---|---|---|---|---|
| Treatment | 25 ml. K. No. | Viscosity (cp.) | Brightness (G.E.) | Color (PT-CO Units) |
| E | 2.06 | 31.0 | 45.5 | 8,200 |
| $E_O$ | 1.76 | 29.4 | 53.5 | 6,900 |
| $E_H$ | 1.41 | 30.0 | 59.0 | 5,300 |
| $E_{OH}$ | 1.46 | 28.2 | 63.7 | 3,800 |
| $(E_{O\rightarrow H})$ | 0.88 | 25.0 | 70.2 | 3,000 |

As reflected in the data set forth in Table IV, the process is also highly effective for use in bleaching pulp derived from hardwoods. In addition, the clearly superior results achieved with the sequential oxygen/hypochlorite reinforced extraction in softwood bleaching was also observed in connection with hardwoods. The hypochlorite addition level may be reduced by 50% (with a corresponding reduction in the caustic required to serve as a buffer), if desired in practice.

The data from all the experiments demonstrate the substantial benefits which are obtainable through the use of an oxygen and hypochlorite reinforced extraction stage. Although some effects on pulp viscosity result from the use of this process, the degree of delignification and brightness improvement are substantially higher relative to the nominal decrease in viscosity. The process results in an improved bleached product with higher ceiling brightness, which is the desired end for any manufacturer of bleached paper products, or equivalent brightness levels with reduced chlorine dioxide use may be achieved. The process also results in extraction stage filtrate with improved environmental characteristics.

In the specification, there have been set forth preferred embodiments of the invention, and although specific terms are employed, they are used in a generic and descriptive sense only and not for purposes of limitation.

What is claimed is:

1. In a multi-stage process for bleaching and delignifying cellulose pulp in which the pulp is subjected to a bleaching stage and to a subsequent caustic extraction stage, the improvement in the caustic extraction stage for achieving enhanced lignin extraction with high brightness and high viscosity, which comprises contacting the bleached pulp as received from the bleaching stage with oxygen and hypochlorite by the steps of first mixing the oxygen with the pulp in the presence of caustic under superatmospheric pressure wherein the pressure is maintained for at least three minutes and the pulp is partially extracted, and then, without intermediate washing of the pump, mixing the hypochlorite with the pulp in the presence of caustic and allowing the extraction to be completed.

2. The process of claim 1 wherein the bleaching stage employs a bleaching agent selected from the group consisting of chlorine, chlorine dioxide, and mixtures thereof under acid conditions.

3. The process of claim 1 wherein the bleaching stage empoys a bleaching agent selected from the group consisting of oxygen, ozone, peroxide, and hypochlorite under alkaline conditions.

4. The process of claim 1 wherein the consistency of the pulp in the caustic extraction stage is from about 8% to 15% on an oven-dried weight basis.

5. The process of claim 1, 2, 3 or 4 comprising additional steps, following the caustic extraction stage, of bleaching the pulp.

6. A process for bleaching and delignifying cellulose pulp, the process being characterized by enhanced delignification with high brightness and viscosity and comprising subjecting the pulp to a bleaching stage which comprises bleaching the pulp and washing the bleached pulp; and then subjecting the washed bleached pulp to a caustic extraction stage which comprises contacting the washed bleached pulp with an amount of caustic sufficient to extract the pulp and to buffer any hypochlorite subsequently mixed with the pulp, mixing the pulp with oxygen under superatmospheric pressure wherein the pressure is maintained for at least three minutes, heating the pulp in the presence of the oxygen to a sufficient temperature and for a sufficient time to extract lignin and impurities from the pulp, and thereafter, without intermediate washing of the pulp, mixing the pulp in the presence of the caustic with hypochlorite, and maintaining the pulp at a temperature and for time sufficient to further extract lignin and impurities from the pulp.

7. The process of claim 6 further comprising the step of elevating the temperature of the pulp in the caustic extraction stage prior to the step of contacting the pulp with the amount of caustic.

8. A process for bleaching and delignifying cellulose pulp, the process being characterized by enhanced delignification with high brightness and viscosity and comprising subjecting the pulp to a bleaching stage which comprises bleaching the pulp and washing the bleached pulp; and then subjecting the washed bleached pulp to a caustic extraction stage which comprises contacting the washed bleached pulp with an amount of caustic sufficient to extract the pulp, mixing the pulp with oxygen under superatmospheric pressure wherein the pressure is maintained for at least three minutes, heating the pulp in the presence of oxygen to a sufficient temperature and for a sufficient time to extract lignin and impurities from the pulp, and thereafter, without intermediate washing of the pulp, mixing the pulp with hypochlorite and with additional caustic to serve as a buffer for the hypochlorite, and maintaining the pulp at a sufficient temperature for a time sufficient to further extract lignin and impurities from the pulp.

9. The process of claim 8 further comprising the step of elevating the temperature of the pulp in the caustic extraction stage prior to the step of contacting the pulp with the amount of caustic.

10. The process of claims 6 or 17 wherein the pulp is a softwood pulp, the amount of caustic and the additional caustic are sufficient to maintain a minimum final pulp pH of 10.5, and wherein the hypochlorite is mixed with the pulp at a concentration level of about 1% to 2% as chlorine on pulp.

11. The process of claims 6 or 8 wherein the pulp is a hardwood pulp, the amount of caustic and the additional caustic are sufficient to maintain a minimum final pulp pH of 10.5, and wherein the hypochlorite is mixed with the pulp at a concentration level of about 0.5% to 1% as chlorine on pulp.

12. The process of claim 6 or 8 wherein the pulp is a mixture of hardwood and softwood pulp, the amount of caustic and said additional caustic are sufficient to maintain a minimum final pulp pH of 10.5, and wherein the hypochlorite is mixed with the pulp at a concentration level of about 0.5% to 2% as chlorine on pulp.

13. The process of claims 6 and 8 wherein the bleaching stage employs a bleaching agent selected from the group consisting of chlorine, chlorine dioxide, and mixtures thereof under acid conditions.

14. The process of claims 6 or 8 wherein the bleaching stage employs a member selected from the group consisting of oxygen, ozone, peroxide, and hypochlorite under alkaline conditions.

* * * * *